US008677962B2

(12) United States Patent
Vukovich et al.

(10) Patent No.: US 8,677,962 B2
(45) Date of Patent: Mar. 25, 2014

(54) CAM PHASER LOCKING SYSTEMS

(75) Inventors: William P. Vukovich, Wyoming, MI (US); Gerald R. Stabel, Zeeland, MI (US); Brian R. Webb, Caledonia, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 26 days.

(21) Appl. No.: 13/463,156

(22) Filed: May 3, 2012

(65) Prior Publication Data

US 2012/0318220 A1 Dec. 20, 2012

Related U.S. Application Data

(60) Provisional application No. 61/498,891, filed on Jun. 20, 2011.

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 6,520,132 | B2 * | 2/2003 | Todo | 123/90.17 |
| 7,363,897 | B2 | 4/2008 | Fischer et al. | |
| 7,614,370 | B2 | 11/2009 | Fischer et al. | |
| 7,669,566 | B2 | 3/2010 | Methley | |
| 2009/0266322 | A1 | 10/2009 | Fischer | |
| 2010/0031906 | A1 | 2/2010 | Cuatt et al. | |

OTHER PUBLICATIONS

T.H. Fischer, M. Sellnau, J. Pfeiffer, D. Gauthier, "Development and Optimization of Intermediate Lock Position Camshaft Phaser System"; SAE International, 2010-01-1192, Apr. 12, 2010.

* cited by examiner

*Primary Examiner* — Zelalem Eshete
(74) *Attorney, Agent, or Firm* — Quinn Law Group, PLLC

(57) ABSTRACT

A motion limiter system for a cam phaser includes a retractable motion limiter pin that is selectively extendable from a rotor in a cam phaser to contact a lobe on a stator to provide a positive stop for the rotor prior to engagement of a locking pin. Alternatively, the cam phaser may include two pins that are selectively extendable from opposite openings in a hole in the rotor to engage seats that are slightly offset from one another.

9 Claims, 5 Drawing Sheets

CAM PHASER LOCKING SYSTEMS

CROSS REFERENCE TO RELATED APPLICATIONS

This application claims the benefit of U.S. provisional patent application No. 61/498,891, filed Jun. 20, 2011, and which is hereby incorporated by reference in its entirety.

TECHNICAL FIELD

This invention relates to systems for selectively locking cam phasers.

BACKGROUND

Engine assemblies may include a cam phaser that is coupled to an engine camshaft to adjust timing of intake and/or exhaust valve opening events. Adjusting valve timing based on engine operating conditions may provide increased engine performance, such as increased power output, reduced fuel consumption, and/or reduced engine emissions. Increasing the extent that the camshaft may be advanced or retarded may provide for increased performance gains.

Typical vane cam phasing devices ("cam phasers") include a rotor and a stator, and have a positive stop position at the default or home position by using interference between the stator and the rotor to stop the rotational movement of the rotor at engine shut down. This allows a locking pin device to engage freely into its seat at engine shut-down to lock the rotor with respect to the stator. The cam phaser is prepared for engine start-up in this locked position. A mid-park cam phaser must lock at an intermediate position where this natural positive stop is not present, i.e., the rotor does not rest against the stator, and thus the lock pin may have difficulty engaging into its seat.

SUMMARY

According to a first aspect of the disclosure, a camshaft phaser includes a stator and a rotor. The stator has a first lobe and a second lobe. The rotor has a vane disposed between the first lobe and the second lobe such that the rotor and the stator define a first chamber between the first lobe and the vane and a second chamber between the second lobe and the vane.

The rotor defines a hole in the vane. A motion limiter pin is selectively movable between a first motion limiter pin position and a second motion limiter pin position. The motion limiter pin extends farther into the first chamber from the hole when the motion limiter pin is in the first motion limiter pin position than when the motion limiter pin is in the second motion limiter pin position. The motion limiter pin may thus contact the first lobe when in the first motion limiter pin position, and thereby maintain the rotor in the mid-park position to facilitate alignment of a locking pin with a seat.

According to a second aspect of the disclosure, a camshaft phaser includes a stator having a plurality of lobes. A rotor has a plurality of vanes, each of the vanes being between two of the lobes. One of the vanes defines a hole that extends through the vane. First and second locking pins are disposed at least partially within the hole. A spring between the pins urges the pins outward from the hole. Each of the pins may protrude from the hole to engage a respective seat to lock the rotor in a mid-park position.

The seats may be elongated to facilitate engagement of the pins in the seats. If the seats are slightly offset from one another, then the lash that would otherwise be caused by the elongation of the seats is reduced or eliminated.

The above features and advantages and other features and advantages of the present invention are readily apparent from the following detailed description of the best modes for carrying out the invention when taken in connection with the accompanying drawings.

DETAILED DESCRIPTION

Figure 1:
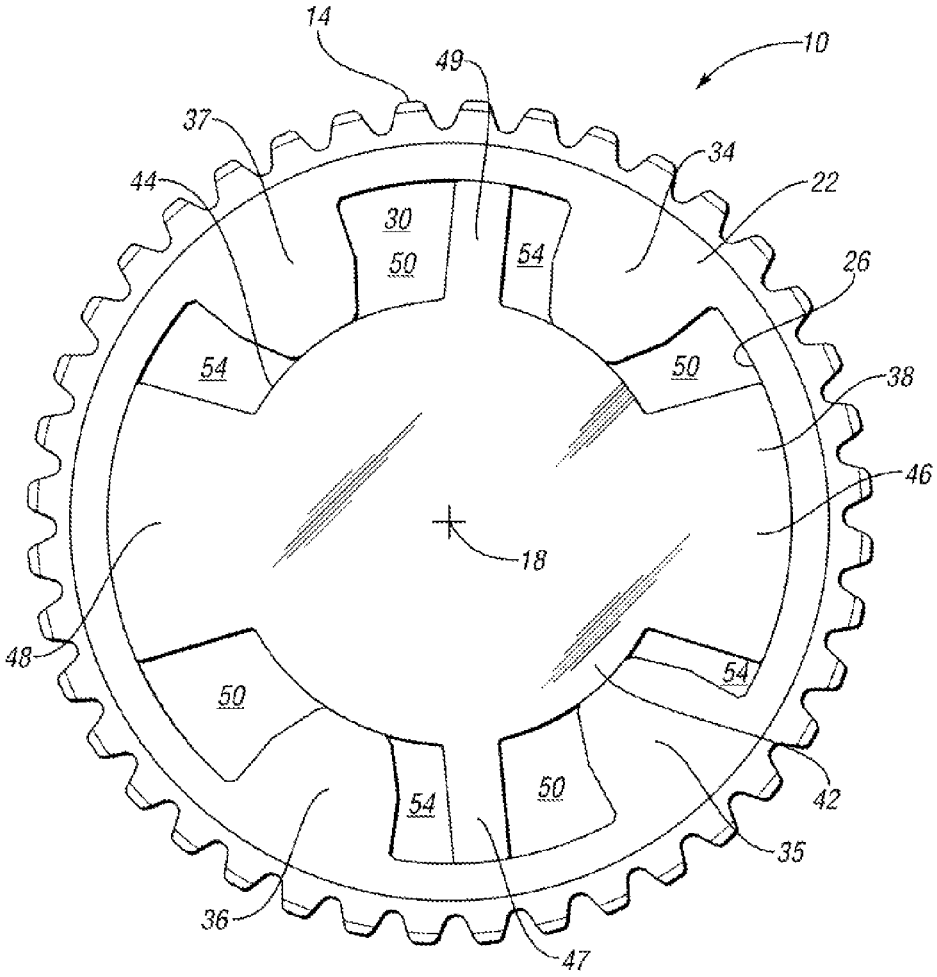
FIG. 1 is a schematic top view of a camshaft phaser.

Referring to FIG. 1, a camshaft phaser 10 is schematically depicted. The camshaft phaser 10 includes a pulley or sprocket 14 for engaging a belt or chain (not shown) operatively connected to an engine crankshaft (not shown). Accordingly, the sprocket 14 is drivable by the engine crankshaft via the chain for rotation about an axis 18. The camshaft phaser 10 also includes a stator 22, which is mounted with respect to the sprocket 14 for unitary rotation therewith about the axis 18. The stator 22 has an inner surface 26 that defines a chamber 30. The inner surface 26 is generally cylindrical, but includes a plurality of lobes 34, 35, 36, 37 that extend radially inward (toward the axis 18).

The camshaft phaser 10 also includes a rotor 38 disposed within the chamber 30. The rotor 38 includes a hub portion 42 having a generally cylindrical outer surface 44. A plurality of vanes 46, 47, 48, 49 extend outward from the hub portion 42. Each vane 46, 47, 48, 49 contacts a respective cylindrical portion of the inner surface 26 of the stator 22. Each of the vanes 46, 47, 48, 49 is disposed between two of the lobes 34, 35, 36, 37. Each lobe 34, 35, 36, 37 contacts a cylindrical portion of the outer surface 44 of the rotor 38. The lobes 34, 35, 36, 37 and the vanes 46, 47, 48, 49 define chambers 50, 54 therebetween. The chambers 50, 54 are selectively pressurized by hydraulic fluid to cause the rotor 38 to rotate about the axis 18 with respect to the stator 22 and thereby change the valve timing in the engine.

More specifically, the rotor 38 is mounted with respect to the camshaft (not shown). Accordingly, rotating the rotor 38 relative to the stator 22 in one direction will advance valve timing; rotating the rotor 38 relative to the stator 22 in the other direction will retard timing. The movement of the rotor 38 relative to the stator 22 is limited by interference between the lobes 34, 35, 36, 37 and the vanes 46, 47, 48, 49. For example, maximum valve timing advance may occur when vane 49 contacts lobe 34, and maximum valve timing retard may occur when vane 49 contacts lobe 37.

Figure 2:
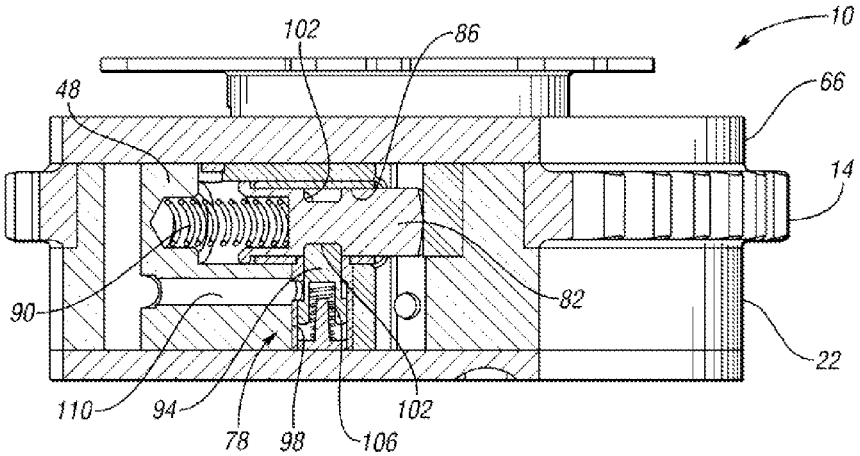
FIG. 2 is a schematic, sectional, side view of the camshaft phaser of FIG. 1.
Figure 3:
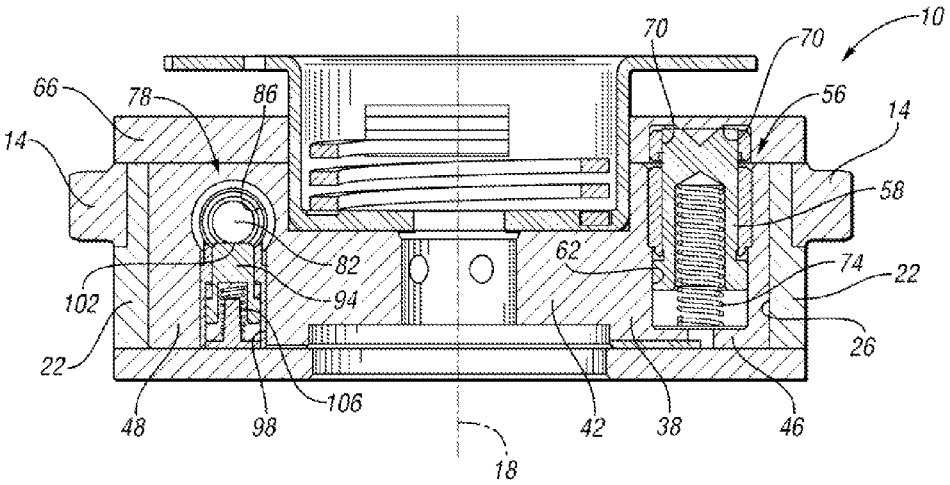
FIG. 3 is a schematic, partial cut-away side view of the camshaft phaser of FIG. 1.

As understood by those skilled in the art, it may be desirable to lock the rotor 38 relative to the stator 22 in a "mid park" position, as shown in FIG. 1, i.e., when the vanes 46, 47, 48, 49 are not in contact with any of the lobes 34, 35, 36, 37. Referring to FIG. 3, wherein like reference numbers refer to like components from FIGS. 1 and 2, a locking system 56 includes a rotor locking pin 58 that is at least partially disposed within a cylindrical bore 62 formed in vane 46. The bore 62 and the pin 58 are oriented and dimensioned such that movement of the pin 58 relative to the rotor 38 is substantially limited to linear translation parallel to the axis 18. The pin 58 is movable relative to the rotor 38 between an extended position, as shown in FIG. 2, and a retracted position. In the extended position, the pin 58 protrudes from the bore 62, and in the retracted position, the pin 58 does not protrude substantially from the bore 62.

A cover 66 is mounted with respect to the stator 22 to seal one end of the chamber 30. The cover 66 defines a generally cylindrical concavity that functions as a seat 70 for the locking pin. The seat 70 is disposed on the cover 66 such that the seat 70 is aligned with the locking pin 58 when the rotor 38 is in the mid park position relative to the stator 22. When the rotor 38 is in the mid park position and the pin 58 is in the extended position, a portion of the pin 58 is in the seat 70, and another portion of the pin 58 is in the bore 62. Accordingly, the pin 58 locks the rotor 38 relative to the cover 66 and the stator 22. A spring 74 is disposed within the bore 62 and biases the pin 58 toward the extended position. The pin 58 is retractable by applying hydraulic pressure.

Figure 4:
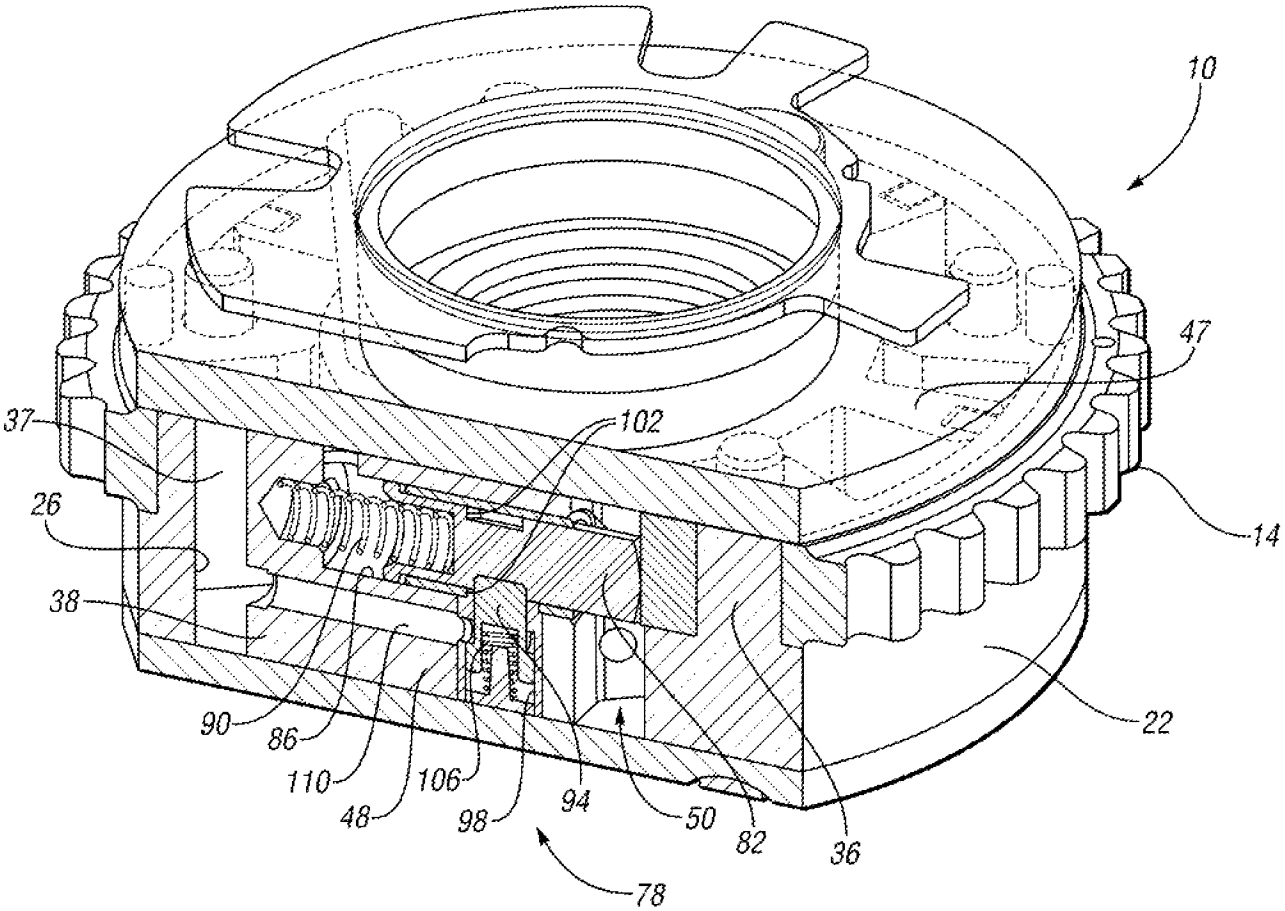
FIG. 4 is a schematic, partial cutaway, perspective view of the camshaft phaser of FIG. 1.

Unless the seat 70 is properly aligned with the pin 58, the pin 58 cannot enter the seat 70, and thus the rotor 38 will not lock. In order to facilitate the alignment and insertion of the pin 58 into the seat 70, the camshaft phaser 10 includes a motion limiter system 78. Referring to FIGS. 2-4, the motion limiter system 78 includes a motion limiter pin 82 that is disposed within a cylindrical bore 86 in vane 48 such that movement of the motion limiter pin 82 relative to the rotor 38 is substantially limited to linear translation. The pin 82 is selectively movable between a first motion limiter pin position, i.e., an extended position, as shown in FIGS. 3 and 4, and a second motion limiter pin position, i.e., a retracted position. In the extended position, the pin 82 protrudes outward from the bore 86 and into the chamber 50 that is formed between the vane 48 and the lobe 36; in the refracted position, the pin 82 does not extend substantially outside of the bore 86. A spring 90 is disposed within the bore 86 and urges the pin 82 toward its extended position.

A motion limiter locking pin 94 is disposed within another cylindrical bore 98 in vane 48. Locking pin 94 is substantially limited to linear translation perpendicular to the movement of motion limiter pin 82. Locking pin 94 is movable between an extended position, as shown in FIGS. 2-4, and a retracted position. The motion limiter pin 82 defines an annular groove 102; when the pin 94 is in the extended position, it is partially disposed within the groove 102, which locks the motion limiter pin 82 relative to the rotor 38. More specifically, in the embodiment depicted, the locking pin 94 interacts with the walls of the groove 102 to prevent translation of the motion limiter pin 82 when the locking pin 94 is in its extended position. When the locking pin 94 is in its retracted position, it is outside the groove 102, and thus the motion limiter pin 82 is free to translate within the bore 86. A spring 106 urges the pin 94 towards its extended position.

Upon engine start-up, engine oil pressure though passage 110 retracts the limiter locking pin 94 from the groove 102 of the motion limiter pin 82, which is followed by engine oil pressure retracting the locking pin 58, thereby allowing full movement of the rotor 38 within the phase range provided by the stator 22. While the rotor 38 is in any controlled position, the motion limiter spring 90 allows the motion limiter pin 82 to retract or extend depending on position of the rotor 38.

Upon engine shutdown oil pressure through the supply passage 110 is lost and the motion limiter locking pin spring 106 forces the limiter locking pin 94 to the locked position in the motion limiter pin groove 102. The motion limiter spring 90 forces the motion limiter pin 82 into position such that the limiter locking pin 94 engages into the motion limiter pin groove 102 and locks the motion limiter pin 82 in the extended position. The motion limiter pin 82 acts as a positive stop for the rotor 38 movement and aligns the phaser lock pin 58 over the lock pin seat 70 for proper engagement at shut down. More specifically, the pin 82 in its extended position protrudes from the vane 48 and contacts the lobe 36. The interaction of the pin 82 and the lobe 36 maintains the rotor 38 in the mid park position to facilitate the insertion of locking pin 58 into seat 70.

This design allows the use of additional retard authority during the cam phasing event by using a mid-park position as the default locking position at start-up. This additional retard authority stabilizes idle and increases fuel economy up to 1%. Without a safe locking mechanism that occurs 100% of the time, the use of the mid park position cam phaser is not possible and the additional fuel economy would not be achieved by this method. The motion limiter pin 82 functions as a positive stop when the rotor is in a mid-park or intermediate position. The lock pin 58 will then be allowed to engage into its seat 70 for proper engine start conditions. Additionally, the motion limiter locking pin 82 can be activated with oil pressure which is present in the typical vane cam phaser under normal conditions without additional oil supply porting and control hardware (oil control valve), although the design has flexibility to use various oil supply methods.

Thus, the camshaft phaser 10 includes a stator 22 having a first lobe 36 and a second lobe 37. A rotor 38 has a vane 48 disposed between the first lobe 36 and the second lobe 37 such that the rotor 38 and the stator 22 define a first chamber 54 between the first lobe 36 and the vane 48 and a second chamber 50 between the second lobe 37 and the vane 48. The rotor 38 defines a hole (i.e., bore 86) in the vane 48, and a motion limiter pin 82 is selectively movable between a first motion limiter pin position to a second motion limiter pin position. The motion limiter pin 82 extends farther into the first chamber 54 from the hole 86 when the motion limiter pin 82 is in the first motion limiter pin position than when the motion limiter pin is in the second motion limiter pin position.

The motion limiter pin 82 defines a concavity (i.e., groove 102), and the camshaft phaser 10 includes a motion limiter locking pin 94 configured to engage the concavity and thereby lock the motion limiter pin 82 in the first motion limiter pin position. Spring 90 urges the motion limiter pin 82 toward the first motion limiter pin position.

The rotor 38 defines a second hole (i.e. bore 62), and a rotor locking pin 58 is selectively movable with respect to the rotor 38 within the second hole. A cover 66 is mounted with respect to the stator 22 and defines a seat 70. The seat 70 is positioned such that the rotor locking pin 58 is aligned with the seat 70 when the motion limiter pin 82 is in the first motion limiter pin position and touches the first lobe 36.

Figure 5:
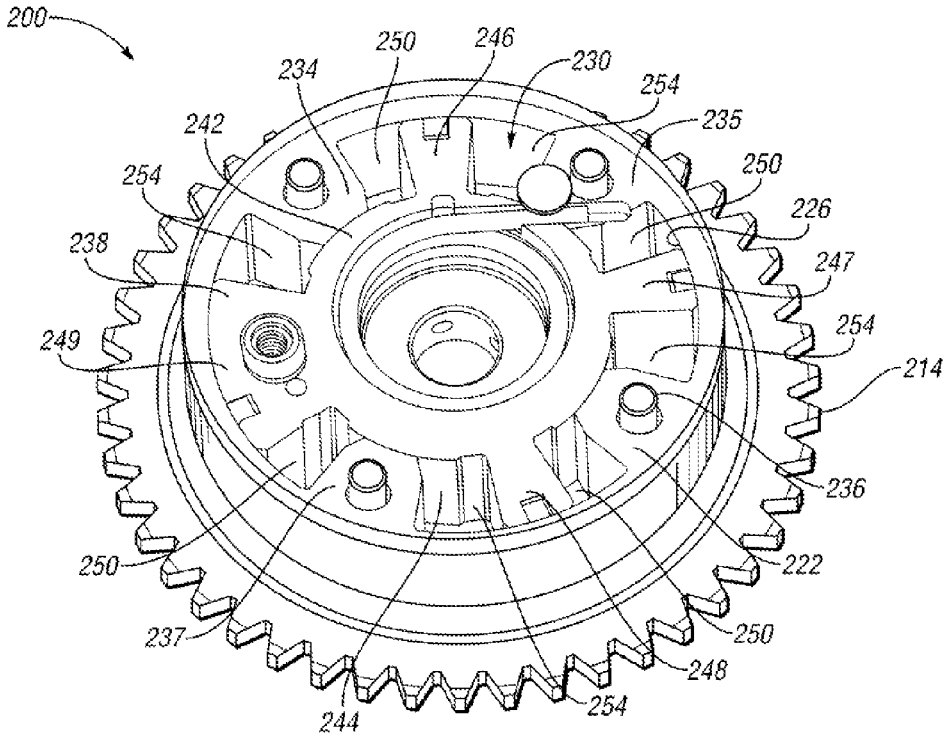
FIG. 5 is a schematic, perspective view of another camshaft phaser.
Figure 6:
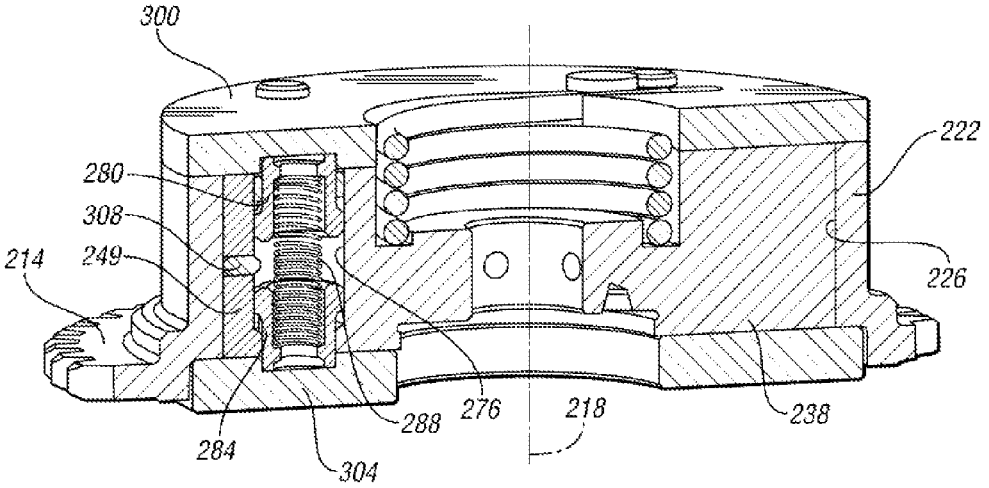
FIG. 6 is a schematic, sectional, perspective view of the camshaft phaser of FIG. 5.

Referring to FIGS. 5 and 6, a camshaft phaser 200 is schematically depicted. The camshaft phaser 200 includes a pulley or sprocket 214 for engaging a belt or chain (not shown) operatively connected to an engine crankshaft (not shown). Accordingly, the sprocket 214 is drivable by the engine crankshaft via the chain for rotation about an axis 218. The camshaft phaser 200 also includes a stator 222, which is mounted with respect to the sprocket 214 for unitary rotation therewith about the axis 218. The stator 222 has an inner surface 226 that defines a chamber 230. The inner surface 226 is generally cylindrical, but includes a plurality of lobes 234, 235, 236, 237 that extend radially inward (toward the axis 18).

The camshaft phaser 200 also includes a rotor 238 disposed within the chamber 230. The rotor 238 includes a hub portion 242 having a generally cylindrical outer surface 244. A plurality of vanes 246, 247, 248, 249 extend outward from the hub portion 242. Each vane 246, 247, 248, 249 contacts a respective cylindrical portion of the inner surface 226 of the stator 222. Each of the vanes 246, 247, 248, 249 is disposed between two of the lobes 234, 235, 236, 237. Each lobe 234, 235, 236, 237 contacts a cylindrical portion of the outer surface 244 of the rotor 238. The lobes 234, 235, 236, 237 and the vanes 246, 247, 248, 249 define chambers 250, 254 therebetween. The chambers 250, 254 are selectively pressurized by hydraulic fluid to cause the rotor 238 to rotate about the axis 218 with respect to the stator 222 and thereby change the valve timing in the engine.

More specifically, the rotor 238 is mounted with respect to the camshaft (not shown). Accordingly, rotating the rotor 238 relative to the stator 222 in one direction will advance valve timing; rotating the rotor 238 relative to the stator 222 in the other direction will retard timing. The movement of the rotor 238 relative to the stator 222 is limited by interference between the lobes 234, 235, 236, 237 and the vanes 246, 247, 248, 249. For example, maximum valve timing advance may occur when vane 249 contacts lobe 234, and maximum valve timing retard may occur when vane 249 contacts lobe 237.

Figure 7:
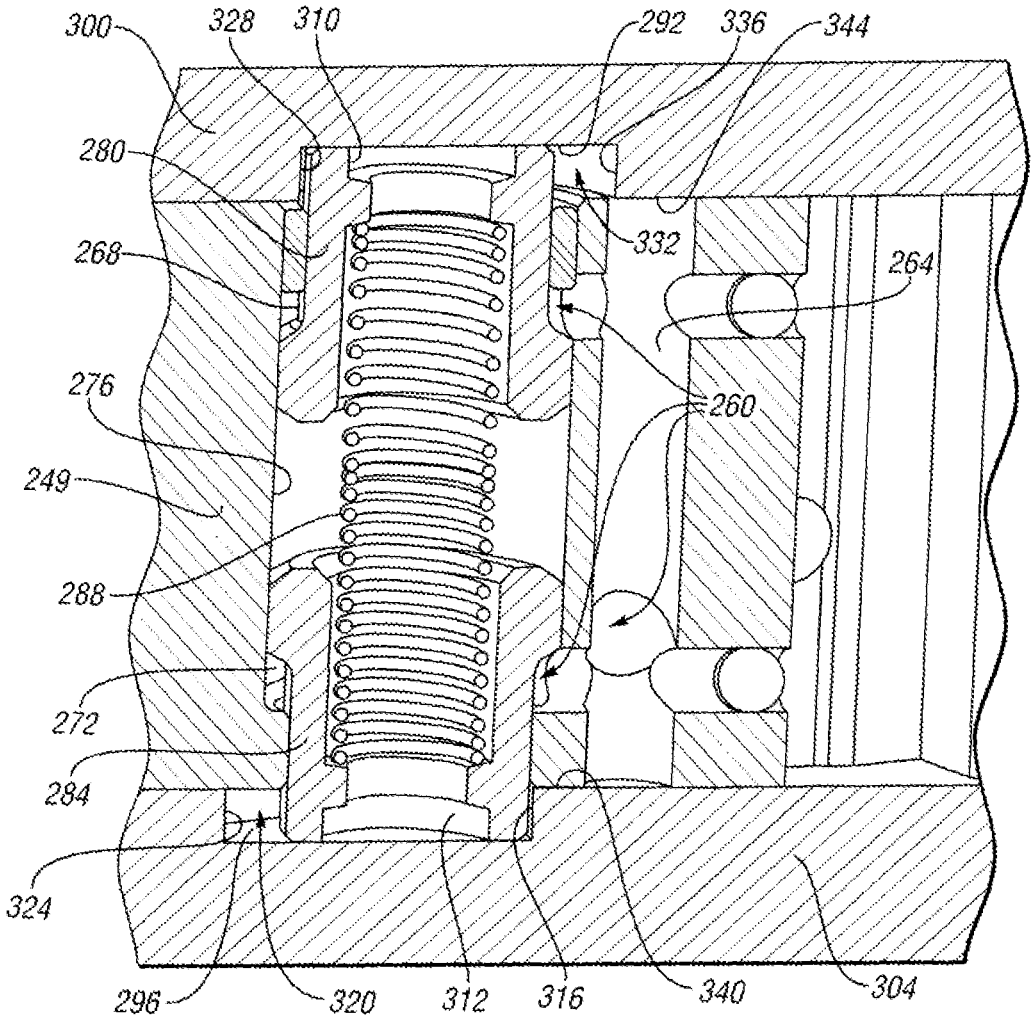
FIG. 7 is a schematic, sectional view of a portion of the camshaft phaser of FIG. 5.

As understood by those skilled in the art, it may be desirable to lock the rotor 238 relative to the stator 222 in a "mid park" position, as shown in FIG. 5, i.e., when the vanes 246, 247, 248, 249 are not in contact with any of the lobes 234, 235, 236, 237. At engine start-up, the phaser 200 is in the mid park position. Referring to FIGS. 5-7, oil 260 which is pressurized by the engine oil pump (not shown) enters passage 264 (which is formed within vane 249) and equally pressurizes chambers 268, 272. The vane 249 defines a cylindrical bore 276, and two lock pins 280, 284 are selectively translatable within the bore 276 parallel to axis 218. Lock pin 280 cooperates with the surface of the bore 276 to define chamber 268. Lock pin 284 cooperates with the surface of the bore 276 to define chamber 272. A spring 288 is disposed between the pins 280, 284 within the bore 276 and biases the pins 280, 284 apart from one another and toward respective extended positions. As the oil pressure is applied to chambers 268, 272, the pressure overcomes the bias of the spring 288, and the lock pins 280, 284 retract towards each other, thereby disengaging from lock pin seats 292, 296 and allowing movement of rotor 238 to the limits given by the stator 222 through pressurizing chambers 254, 250. Lock pin seats 292, 296 are formed within covers 300, 304, respectively. Covers 300, 304 are mounted to the stator 222.

Pin 308 in FIG. 6 extends into the bore 276 and assures that either lock pin 280, 284 does not use all the axial movement and keep the other lock pin from disengagement. More specifically, pin 308 is mounted to the vane 249 and extends into the bore 276 such that at least a portion of the pin 308 extends between the lock pins 280, 284, thereby preventing either of the pins 280, 284 from moving past the center portion of the bore 276. Lock pin spring 288 is designed such that neither pin 280, 284 disengages prior to the minimum operating pressure but yet allows for disengagement of both pins at the maximum operating pressure. High pressure chambers 250, 254 are fed with oil pressure typical of cam phasers using a 3-position spool valve. High pressure chambers 268, 272 for lock pin disengagement use an additional oil supply using an on/off control valve.

On engine shut-down the lock pins 280, 284 must be engaged into the seats 292, 296 to lock the rotor 238 in its mid-park position. The pressure to the lock pins 280, 284 via chambers 268, 272 is removed using the on/off control valve when the engine is keyed off. This allows lock pin spring 288 to force the lock pins 280, 284 into the direction of their respective seats 292, 296. Hydraulic locking does not occur due to holes 310, 312 in the ends of lock pins 280, 284. The elongated nature of the lock pin seats 292, 296 allow time for the pins 280, 284 to fall into the hole as the rotor 238 moves to a commanded shut down position.

At final rest position (default), lock pin 284 is shown to be in contact with the wall 316 of lock pin seat 296, while a gap 320 exists between the pin 284 and wall 324 of the seat 296. Similarly, lock pin 280 is shown to be in contact with the wall 328 of lock pin seat 292, while a gap 332 exists between the pin 280 and wall 336 of the seat 292. This lash in the system, which is provided by the gaps 320, 332, is important to control to a minimum for noise or rattle at start-up. In this design, the two lock pins 280, 284 maintain lash for each other for re-engagement.

Lash is maintained between pin 280 on wall 328 and pin 284 on wall 316. Either pin 280, 284 can engage its respective seat 292, 296 prior to the other. If pin 280 engages first while moving in the counterclockwise direction and prior to contacting surface 328 by the amount of pin lash, pin 284 slides along surface 340 of cover 304 until lash is present. Pin 284 then passes by surface 316 and engages into its seat 296. If traveling in the clockwise direction, then the operation reverses with pin 284 engaging first.

Thus, phaser 200 includes a stator 222 having a plurality of lobes 234, 235, 236, 237. A rotor 238 has a plurality of vanes 246, 247, 248, 249, each of the vanes being between two of the lobes, and one of the vanes 249 defining a hole (i.e., bore 276) therethrough. First and second locking pins 280, 284 are disposed at least partially within the hole 276. A spring 288 is between the pins 280, 284, urging the pins 280, 284 outward from the hole 276.

A first cover 300 is mounted with respect to the stator 222 and defines a first pin seat 292. A second cover 304 is mounted with respect to the stator 222 and defines a second pin seat 296. The first and second pin seats 292, 296 are positioned such that the rotor 222 is in a mid-park position when the first and second locking pins 280, 284 are aligned with the first and second pin seats 292, 296.

The first locking pin 280 and the rotor 238 cooperate to define a first chamber 268. The second locking pin 284 and the rotor 238 cooperate to define a second chamber 272. The vane 249 defines a passageway 264 in fluid communication with the first and second chambers 268, 272. The first and second locking pins 280, 284 and the rotor 238 are configured such that fluid pressure in the passageway 264 and the first and second chambers 268, 272 urges the first and second locking pins 280, 284 toward each other and out of engagement with the seats 292, 296.

The first cover 300 includes a first wall (i.e., surface 336) that at least partially defines the first pin seat 292. The second cover 304 includes a second wall (i.e., surface 324) that at least partially defines the second pin seat 296. The first and second seats 292, 296 are elongated such that, when the first locking pin 280 is in the first pin seat 292 and the second pin 284 is in the second pin seat 296, the first pin 280 and the first wall 336 define a first gap 332 therebetween, and the second pin 284 and the second wall 324 define a second gap 320 therebetween.

The first cover 300 includes a first surface 344 that faces the rotor 238 and that surrounds the first pin seat 292. The second cover 304 includes a second surface 340 that faces the rotor 238 and the first surface 344, and that surrounds the second pin seat 296. The rotor 238 is selectively rotatable with respect to the stator 222 about axis 218. The first and second pin seats 292, 296 are positioned and configured such that, when the rotor 238 rotates about the axis 218 in a first direction, the second pin 284 remains in contact with the second surface 340 while the first pin 280 enters the first pin seat 292.

Similarly, the first and second pin seats 292, 296 are positioned and configured such that, when the rotor 238 rotates about the axis 218 in a second direction opposite the first direction, the first pin 280 remains in contact with the first surface 344 while the second pin 284 enters the second pin seat 296.

While the best modes for carrying out the invention have been described in detail, those familiar with the art to which this invention relates will recognize various alternative designs and embodiments for practicing the invention within the scope of the appended claims.

The invention claimed is:

1. A camshaft phaser comprising:

a stator having a first lobe and a second lobe;

a rotor having a vane disposed between the first lobe and the second lobe such that the rotor and the stator define a first chamber between the first lobe and the vane and a second chamber between the second lobe and the vane;

said rotor defining a first hole in the vane; and a motion limiter pin being selectively movable between a first motion limiter pin position and a second motion limiter pin position;

wherein the motion limiter pin extends farther into the first chamber from the hole when the motion limiter pin is in the first motion limiter pin position than when the motion limiter pin is in the second motion limiter pin position.

2. The camshaft phaser of claim 1, wherein the motion limiter pin defines a concavity; and wherein the camshaft phaser further includes a motion limiter locking pin configured to engage the concavity and thereby lock the motion limiter pin in the first motion limiter pin position.

3. The camshaft phaser of claim 2, further comprising a spring urging the motion limiter pin toward the first motion limiter pin position.

4. The camshaft phaser of claim 2, wherein the rotor defines a second hole;

wherein the camshaft phaser further comprises a rotor locking pin being selectively movable with respect to the rotor within the second hole; and a cover mounted with respect to the stator and defining a seat;

wherein the seat is positioned such that the rotor locking pin is aligned with the seat when the motion limiter pin is in the first motion limiter pin position and touches the first lobe.

5. A camshaft phaser comprising:

a stator having a plurality of lobes;

a rotor having a plurality of vanes, each of the vanes being between two of the lobes, and one of the vanes defining a hole therethrough;

first and second locking pins being disposed at least partially within the hole;

a spring between the pins urging the pins outward from the hole;

a first cover mounted with respect to the stator and defining a first pin seat; and a second cover mounted with respect to the stator and defining a second pin seat;

wherein the first and second pin seats are positioned such that the rotor is in a mid-park position when the first and second locking pins are aligned with the first and second pin seats.

6. The camshaft phaser of claim 5, wherein the first locking pin and the rotor cooperate to define a first chamber;

wherein the second locking pin and the rotor cooperate to define a second chamber;

wherein the rotor defines a passageway in fluid communication with the first and second chambers; and wherein the first and second locking pins and the rotor are configured such that fluid pressure in the passageway and the first and second chambers urges the first and second locking pins toward each other.

7. The camshaft phaser of claim 5, wherein the first cover includes a first wall that at least partially defines the first pin seat;

wherein the second cover includes a second wall that at least partially defines the second pin seat;

wherein the first and second seats are elongated such that, when the first locking pin is in the first pin seat and the second pin is in the second pin seat, the first pin and the first wall define a first gap therebetween, and the second pin and the second wall define a second gap therebetween.

8. The camshaft phaser of claim 7, wherein the first cover includes a first surface that faces the rotor and that surrounds the first pin seat;

wherein the second cover includes a second surface that faces the rotor and the first surface, and that surrounds the second pin seat;

wherein the rotor is selectively rotatable with respect to the stator about an axis;

wherein the first and second pin seats are positioned and configured such that, when the rotor rotates about the axis in a first direction, the first pin enters the first pin seat when the second pin contacts the second surface.

9. The camshaft phaser of claim 8, wherein the first and second pin seats are positioned and configured such that, when the rotor rotates about the axis in a second direction opposite the first direction, the second pin enters the second pin seat when the first pin contacts the first surface.

* * * * *